US009638478B2

(12) United States Patent
Byman

(10) Patent No.: US 9,638,478 B2
(45) Date of Patent: May 2, 2017

(54) HEAT EXCHANGER FOR COOLING BULK SOLIDS

(71) Applicant: SOLEX THERMAL SCIENCE INC., Calgary (CA)

(72) Inventor: Ashley Dean Byman, De Winton (CA)

(73) Assignee: SOLEX THERMAL SCIENCE INC., Calgary (CA)

( * ) Notice: Subject to any disclaimer, the term of this patent is extended or adjusted under 35 U.S.C. 154(b) by 377 days.

(21) Appl. No.: 14/341,440

(22) Filed: Jul. 25, 2014

(65) Prior Publication Data

US 2016/0025417 A1 Jan. 28, 2016

(51) Int. Cl.

| | |
|---|---|
| ***F28F 3/14*** | (2006.01) |
| ***F28F 9/02*** | (2006.01) |
| ***F28D 7/08*** | (2006.01) |
| *F28D 21/00* | (2006.01) |

(52) U.S. Cl.

CPC ..... *F28F 3/14* (2013.01); *F28D 7/082* (2013.01); *F28F 9/0246* (2013.01); *F28D 2021/0045* (2013.01); *F28F 2230/00* (2013.01)

(58) Field of Classification Search

CPC C10J 3/52; F26B 17/126; F26B 17/16; F28D 7/0066; F28D 7/087; F28D 7/1615; F28D 7/1623; F28D 9/00; F28D 9/006; F28D 9/0093; F28D 9/0031; F28D 2021/0045; F28D 7/082; F28F 1/045; F28F 3/14; F28F 9/0246; F28F 2230/00

See application file for complete search history.

(56) References Cited

U.S. PATENT DOCUMENTS

| | | | | | |
|---|---|---|---|---|---|
| 2,276,496 | A * | 3/1942 | Kennedy | F27D 15/0286 | 34/170 |
| 2,911,198 | A * | 11/1959 | Karlsson | F28C 3/14 | 165/111 |
| 3,872,606 | A * | 3/1975 | Kashul | B65G 69/20 | 34/166 |
| 4,014,642 | A * | 3/1977 | Helming | B02C 4/02 | 241/66 |
| 5,167,274 | A * | 12/1992 | Mueller | B01J 2/04 | 165/170 |
| 5,727,689 | A * | 3/1998 | Anderson | B02B 1/08 | 209/139.1 |
| 6,328,099 | B1 * | 12/2001 | Hilt | C05G 3/0058 | 165/166 |

(Continued)

*Primary Examiner* — Tho V Duong

(74) *Attorney, Agent, or Firm* — Borden Ladner Gervais LLP; Geoffrey deKleine

(57) ABSTRACT

A heat exchanger comprises a housing that includes an inlet for receiving bulk solids having a first temperature, and an outlet for discharging the bulk solids. A plurality of spaced apart, substantially parallel heat transfer tubes are disposed within the housing between the inlet and the outlet, for cooling the bulk solids that flow from the inlet into spaces between heat transfer tubes, to a second intermediate temperature, and a plurality of spaced apart, substantially parallel heat transfer plate assemblies disposed within the housing and interposed between the plurality of heat transfer tubes and the outlet for further cooling the bulk solids that flow from the spaces between heat transfer tubes, to spaces between heat transfer plate assemblies and to the outlet, to a third temperature.

18 Claims, 10 Drawing Sheets

(56) References Cited

U.S. PATENT DOCUMENTS

| | | | | |
|---|---|---|---|---|
| 7,093,649 | B2 * | 8/2006 | Dawson | F28D 9/0031 165/166 |
| 2007/0256316 | A1 * | 11/2007 | Jordison | F26B 17/16 34/65 |
| 2012/0196239 | A1 * | 8/2012 | Hamel | C10J 3/52 432/9 |
| 2013/0292093 | A1 * | 11/2013 | Huang | F28F 3/044 165/104.15 |

* cited by examiner

HEAT EXCHANGER FOR COOLING BULK SOLIDS

FIELD OF THE INVENTION

The present disclosure relates to a heat exchanger for cooling bulk solids, for example, metal powders, ash, coke, coals, carbon powders, and graphite powders.

BACKGROUND

Heat exchangers are used to cool bulk solids that have a high temperature and that flow, under the force of gravity, through the heat exchanger. The operation life of known heat exchangers is limited because indirect cooling elements of the heat exchanger become worn as the bulk solids flow through the heat exchanger. Improvements to heat exchangers to extend their operational life are therefore desirable.

SUMMARY

According to one aspect of an embodiment, a heat exchanger includes a housing including an inlet for receiving bulk solids having a first temperature, and an outlet for discharging the bulk solids. A plurality of spaced apart, substantially parallel heat transfer tubes are disposed within the housing between the inlet and the outlet, for cooling the bulk solids that flow from the inlet, to spaces between heat transfer tubes, to the outlet, to a second intermediate temperature, and a plurality of spaced apart, substantially parallel heat transfer plate assemblies disposed within the housing and interposed between the plurality of heat transfer tubes and the outlet for further cooling the bulk solids that flow from the spaces between heat transfer tubes, to spaces between the heat transfer plate assemblies, and to the outlet, to a third temperature.

The first temperature may be between about 400° C. and about 2400° C., the second intermediate temperature may be less than the first temperature and greater than or equal to about 400° C., and the third temperature may be about 400° C. or less. The first ones of the plurality of heat transfer tubes may be arranged in a first row, and second ones of the plurality of heat transfer tubes may be arranged in a second row such that the heat transfer tubes of the second row are spaced from the heat transfer tubes of the first row. Each heat transfer tube of the second row may be disposed between adjacent heat transfer tubes of the first row. The third ones of the plurality of heat transfer tube assemblies may be arranged in a third row such that the heat transfer tube assemblies of the third row are spaced and aligned with respective heat transfer plate assemblies of the first row.

According to another aspect of an embodiment, the heat exchanger includes a refractory lining disposed within the housing between a first sidewall of the housing and the heat transfer tubes adjacent the first sidewall of the housing for cooling the bulk solids that flow between the first sidewall of the housing and the first heat transfer tubes located adjacent the first sidewall of the housing. The refractory lining may also be disposed within the housing between an opposing second sidewall of the housing and the heat transfer tube assemblies located adjacent the second sidewall of the housing to reduce the chance of overheating the housing.

According to another aspect of an embodiment, a first end of the heat transfer tube assemblies may pass through the first sidewall of the housing and a second end of the heat transfer tube assemblies pass through the second sidewall of the housing. The first end of the heat transfer tube assemblies of the first row may be coupled to the first sidewall of the housing by a first seal.

According to another aspect of an embodiment, the heat exchanger also includes a cooling fluid inlet manifold in fluid communication with each first seal for providing cooling fluid into each heat transfer tube assembly of the first row. The second end of each heat transfer tube assembly of the first row may be in fluid communication with the second end of each heat transfer tube assembly of the second row for providing cooling fluid into each heat transfer tube assembly of the second row. The first end of each heat transfer tube assembly of the second row may be coupled to the first sidewall of the housing by a second mechanical seal.

According to another aspect of an embodiment, the heat exchanger also includes a cooling fluid discharge manifold in fluid communication with each second seal for receiving cooling fluid discharged from each heat transfer tube assembly of the second row. The cooling fluid may be liquid. The liquid may be one of water and thermal oil. Alternatively, the cooling fluid may be a gas under pressure. Each of the plurality of heat transfer plate assemblies are low temperature heat transfer plate assemblies. Each of the plurality of heat transfer plate assemblies may be high temperature heat transfer plate assemblies.

According to another aspect of an embodiment, the heat exchanger also includes a plurality of spaced apart, substantially parallel low temperature heat transfer plate assemblies disposed within the housing and interposed between the plurality of high temperature heat transfer plate assemblies and the outlet for further cooling the bulk solids that flow from the spaces between high temperature heat transfer plate assemblies, to spaces between the low temperature heat transfer plate assemblies and to the outlet, to a fourth temperature. The first temperature may be about 2400° C., the second intermediate temperature may be less than the first temperature and greater than or equal to about 400° C., and the third temperature may be about 400° C. or less.

BRIEF DESCRIPTION OF THE DRAWINGS

Embodiments of the present invention will be described, by way of example, with reference to the drawings and to the following description, in which.

DETAILED DESCRIPTION OF THE PREFERRED EMBODIMENTS

Figure 1:
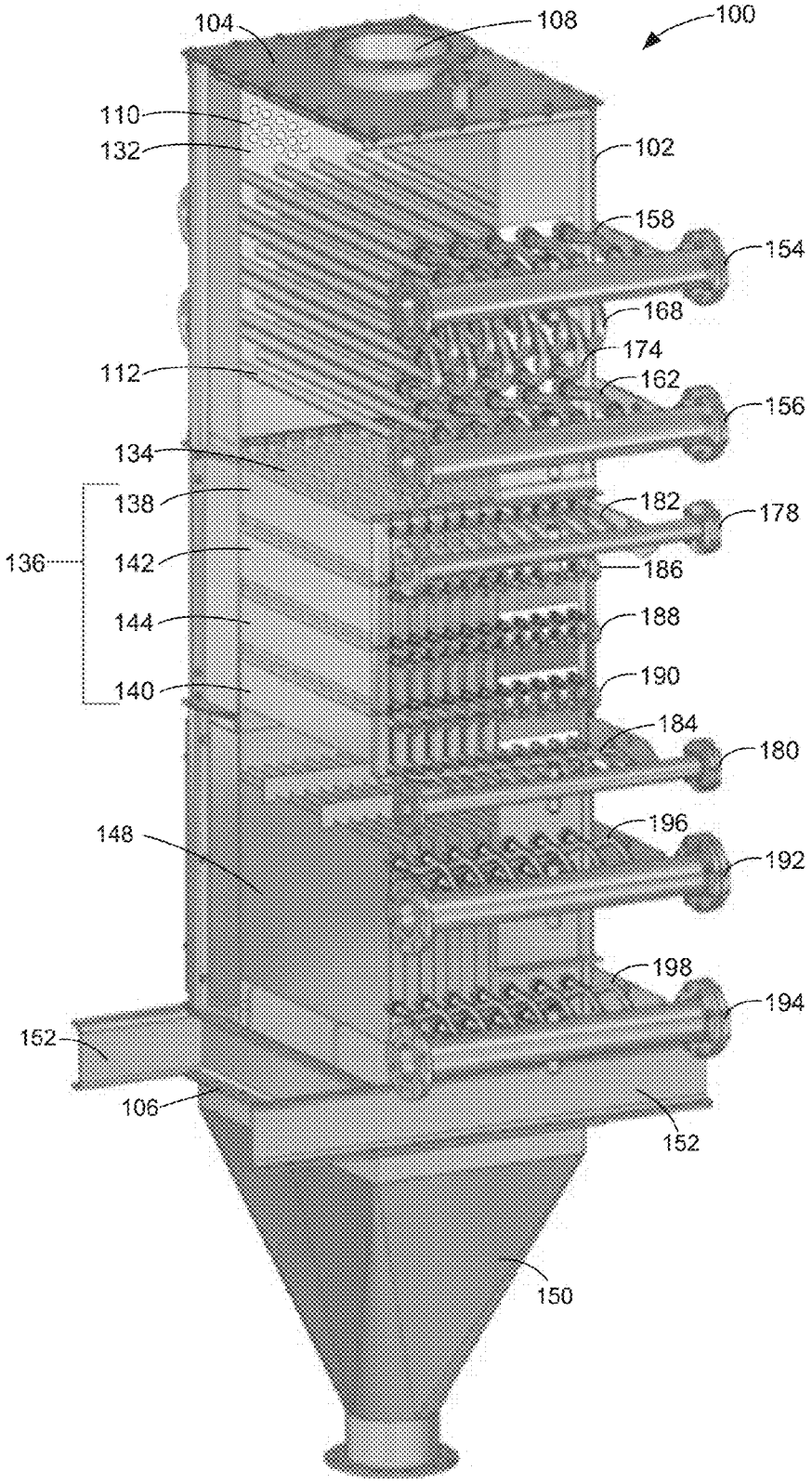
FIG. 1 is a partially cut away front perspective view of a heat exchanger for cooling bulk solids in accordance with an embodiment.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described. The description is not to be considered as limited to the scope of the embodiments described herein.

The disclosure generally relates to heat exchangers for cooling bulk solids that have a temperature, for example, in the range of about 400° C. to about 2400° C. Examples of bulk solids include metal powders, ash, coke, coals, carbon powders, graphite powders, and other solids that flow under the force of gravity.

Figure 2:
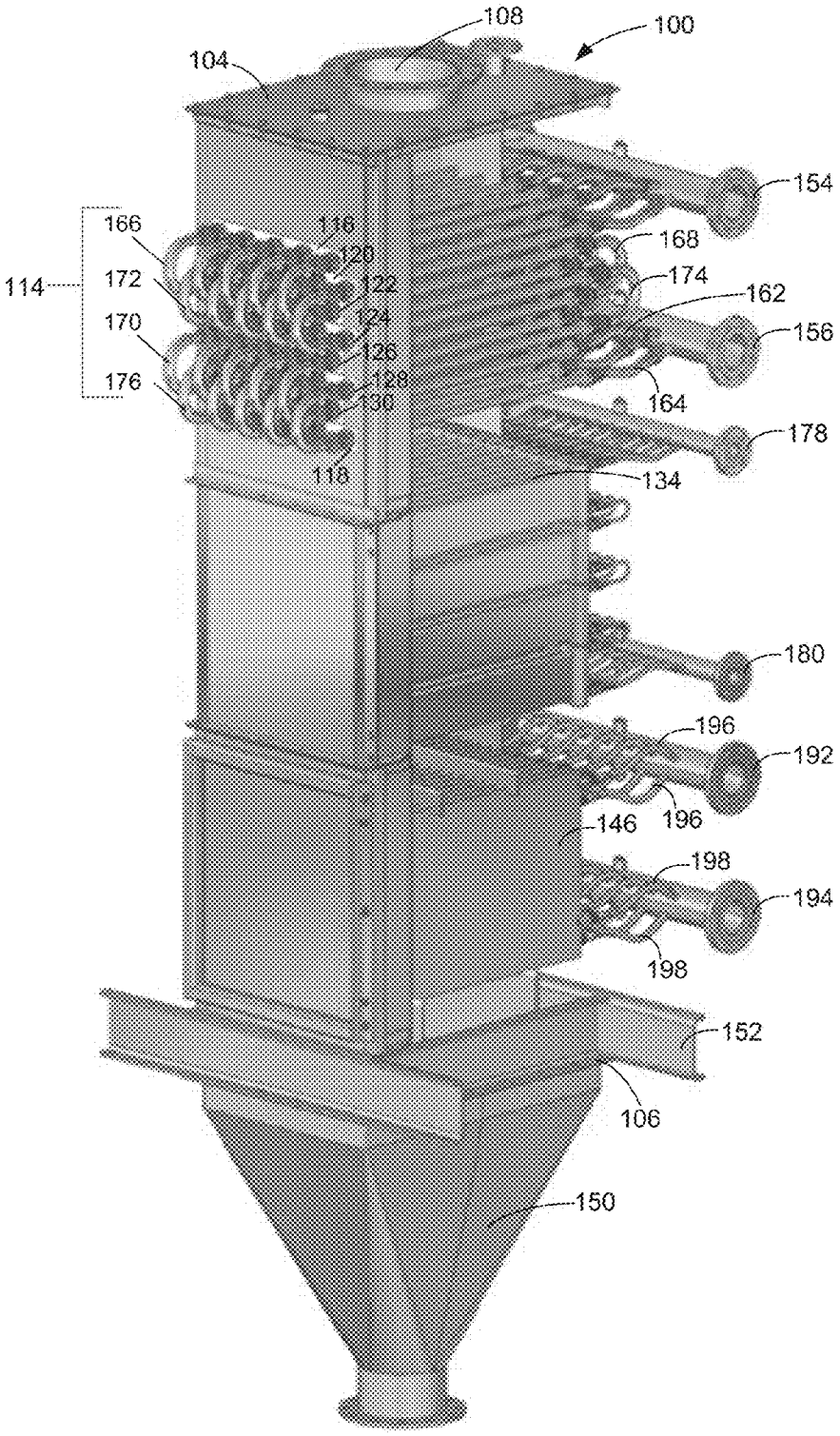
FIG. 2 is a partially cut away rear perspective view of the heat exchanger of FIG. 1.

FIG. 1 and FIG. 2 show partially cutaway front and rear perspective views of an embodiment of a heat exchanger for cooling bulk solids. The heat exchanger 100 includes a housing 102 with a generally rectangular cross-section. The housing 102 has a top 104 and a bottom 106. The top 104 of the housing 102 includes an inlet 108 for introducing bulk solids 110 into the heat exchanger 100, such as bulk solids 110 that have a temperature in the range of about 400° C. to about 2400° C. For example, bulk solids 110 that have a temperature of about 750° C. may be introduced into the heat exchanger 100 through the inlet 108. The bottom 106 of the housing 102 of the heat exchanger 100 is open to provide an outlet (not shown) for discharging cooled bulk solids from the housing 102 of the heat exchanger 100. A vertical axis, referred to herein, extends from a center of the inlet 108 to a center of the outlet.

A plurality of heat transfer tubes 112 are disposed within the housing 102, between the inlet 108 and the outlet. The heat transfer tubes 112 are horizontally spaced apart along an axis that extends transverse to the vertical axis and are arranged generally parallel to each other in rows, referred to herein as a tube bank. In the example shown in FIG. 1 and FIG. 2, the heat exchanger 100 includes eight tube banks. The eight tube banks are arranged in a stack, referred to herein as tube stack 114. The tube stack 114 includes a top tube bank 116, a bottom tube bank 118, and six intermediate tube banks 120, 122, 124, 126, 128, and 130. For the purpose of the present example, each heat tube bank 116, 118, 120, 122, 124, 126, 128, 130 includes five heat transfer tubes 112. Although the heat exchanger 100 of FIG. 1 and FIG. 2 includes eight tube banks, other suitable numbers of tube banks may be utilized. Also, other suitable numbers of heat transfer tubes 112 in each tube bank may be utilized.

The top tube bank 116 of the tube stack 114 (i.e. the heat transfer tube bank that is located closest to the inlet 108) is sufficiently spaced from the inlet 108 to provide a hopper 132 in the housing 102 between the inlet 108 and the top tube bank 116. The hopper 132 facilitates distribution of bulk solids 110 that flow from the inlet 108, as a result of the force of gravity, over the heat transfer tubes 112 of the top tube bank 116 by disbursing the bulk solids 110 over the entire cross-section of the heat exchanger 100 as bulk solids 110 flow from the inlet 108 into the housing 102.

The heat exchanger 100 also includes a plurality of heat transfer plate assemblies for cooling bulk solids, such as solids that have a temperature between 2400° C. and 400° C., referred herein to as high temperature heat transfer plate assemblies 134. The high temperature heat transfer plate assemblies 134 are disposed within the housing 102 and interposed between the heat transfer tubes 112 (i.e. the tube stack 114) and the outlet. The high temperature heat transfer plate assemblies 134 are horizontally spaced apart spaced apart along an axis that extends transverse to the vertical axis and are arranged generally parallel to each other in rows, referred to herein as an assembly bank. In the example shown in FIG. 1 and FIG. 2, the heat exchanger 100 includes four assembly banks. The four assembly banks are arranged in a stack, referred herein to as an assembly stack 136. The assembly stack 136 includes a top assembly bank 138, a bottom assembly bank 140, and two intermediate assembly banks 142, 144. For the purpose of the present example, each assembly bank 138, 140, 142, 144 includes eleven high temperature heat transfer plate assemblies 134. Although the heat exchanger 100 of FIG. 1 and FIG. 2 includes four assembly banks 138, 140, 142, 144, other suitable numbers of assembly banks may be utilized. Also, other suitable numbers of high temperature heat transfer plate assemblies 134 in each assembly bank may be utilized.

The heat exchanger 100 also includes a plurality of heat transfer plate assemblies for cooling bulk solids that have a temperature less than 400° C., hereinafter referred to as low temperature heat transfer plate assemblies 146. The low temperature heat transfer plate assemblies 146 are disposed within the housing 102 and interposed between the high temperature heat transfer plate assemblies 134 (i.e. the assembly stack 136) and the outlet. The low temperature heat transfer plate assemblies 146 are horizontally spaced apart spaced apart along the axis that extends transverse to the vertical axis and are arranged generally parallel to each other in rows, referred to herein as a bank. In the example shown in FIG. 1 and FIG. 2, the heat exchanger 100 includes a single bank 148. For the purpose of the present example, the bank 148 includes seven low temperature heat transfer plate assemblies 146. Although the heat exchanger 100 of FIG. 1 and FIG. 2 includes a single bank 148, other suitable numbers of banks 148 may be utilized. Also, other suitable numbers of low temperature heat transfer plate assemblies 146 in the bank 148 may be utilized.

The bank 148 is sufficiently spaced from the outlet to facilitate the flow of bulk solids 110 through the outlet and out of the housing 102. Optionally, the heat exchanger 100 includes a discharge hopper 150 that is coupled to the housing 102 at the outlet. The discharge hopper 150 is utilized to create a mass flow or "choked flow" of bulk solids and to regulate the flow rate of the bulk solids 110 out of the heat exchanger 100. An example of a discharge hopper 150 is described in U.S. Pat. No. 5,167,274. The term "choked flow" is utilized herein to refer to a flow other than a free fall of the bulk solids 110 as a result of the force of gravity.

The tube stack 114, including the eight tube banks 116, 118, 120, 122, 124, 126, 128, 130, the assembly stack 136, including the four assembly banks 138, 140, 142, 144, and the bank 148, are supported on support channels 152 at the bottom of the bank 148. The support channels 152 support the tube stack 114, the assembly stack 136, the bank 148, and the weight of the bulk solids 110 introduced into the heat exchanger 100 as the weight of the bulk solids 110 is transferred to the heat transfer tubes 112, the high temperature heat transfer plate assemblies 134, and the low temperature heat transfer plate assemblies 146.

Figure 3:
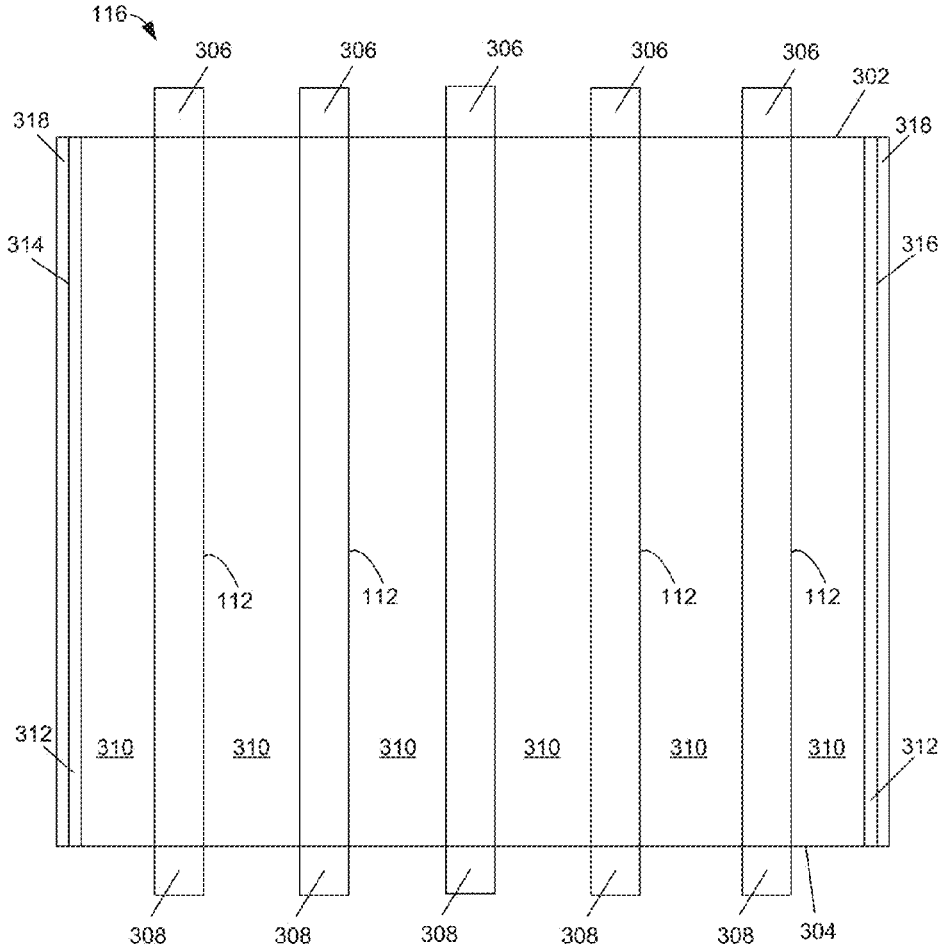
FIG. 3 is a top view of a top bank of heat transfer tubes of the heat exchanger of FIG. 1.

Referring to FIG. 3, a top view of the top tube bank 116 of the heat exchanger 100 of FIG. 1 is shown. Each heat transfer tube 112 of the top tube bank 116 extends a width of the housing 102 between the first side wall 302 and an opposing second side wall 304 of the housing 102. A first end 306 of each heat transfer tube 112 passes through an opening (not shown) in the first side wall 302 of the housing 102 such that the first end 306 extends out of the housing 102. A second end 308 of each heat transfer tube 112 passes through an opening (not shown) in the second side wall 304 of the housing 102 such that the second end 308 extends out of the housing 102. The heat transfer tubes 112 of the top tube bank 116 are arranged generally parallel to each other with spaces between adjacent heat transfer tubes 112. Each space between adjacent heat transfer tubes 112 defines a passageway 310 for bulk solids 110 to flow through. Optionally, a heat resistant lining 312 may be disposed between a third side wall 314 of the housing 102, and the heat transfer tube 112 located adjacent to or near the third side wall 314. A heat resistant lining 312 may also be disposed between a fourth side wall 316 of the housing 102 and the heat transfer tube 112 located adjacent to or near a fourth side wall 316. The fourth side wall 316 is opposite the third side wall 314. Also, a water-jacket skin 318 may be disposed on an outer surface of the third side wall 314 and an outer surface of the fourth side wall 316. The heat resistant lining 312 is utilized to protect the water-jacket skin 318, for example, in areas of the water-jacket skin 318 in which water flow is not sufficient.

The heat resistant lining 312 may be made from any suitable material to withstand the temperatures of the bulk solids and that has sufficient mechanical strength to withstand flow of the bulk solids. Examples of materials for the heat resistant lining 312 include graphite or any other suitable insulating material, such as a refractory board or other fibrous or foam type board. The water-jacket skin 318 may be made from any suitable material, such as Type 314L stainless steel or Type 316L stainless steel. The bottom tube bank 118 and the six intermediate tube banks 120, 122, 124, 126, 128, and 130 have a similar configuration as the top tube bank 116.

Figure 4:
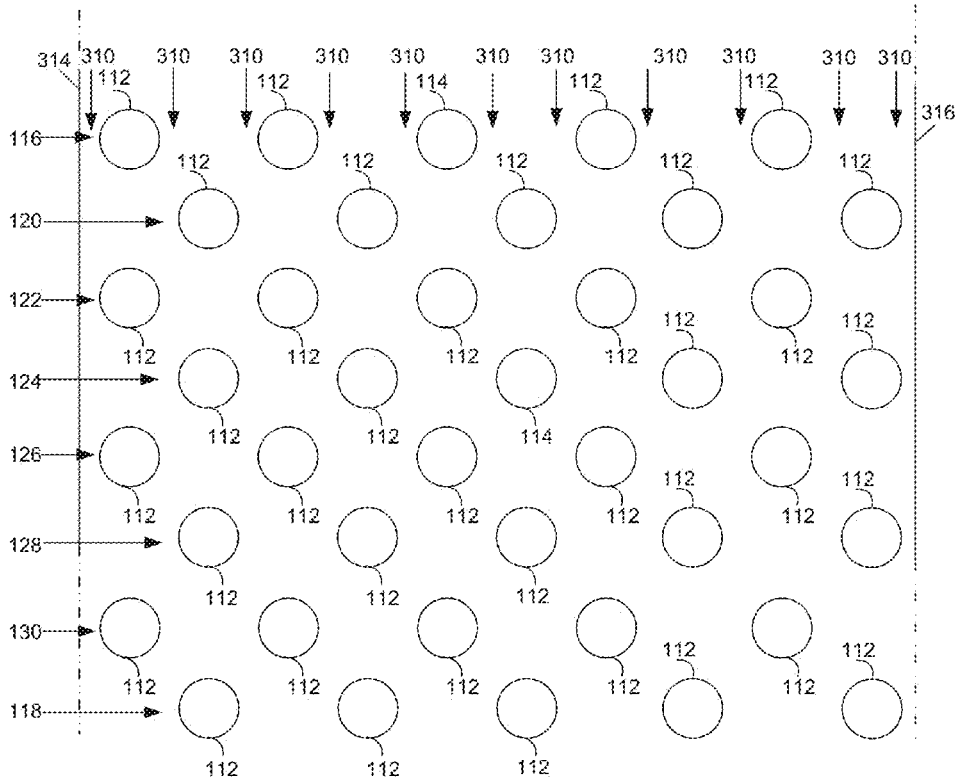
FIG. 4 is an end view of an example embodiment of a heat transfer tube stack of the heat exchanger of FIG. 1.

Referring to FIG. 4, an end view of the tube stack 114 of the heat exchanger 100 of FIG. 1 is shown. The heat transfer tubes 112 of the top tube bank 116, and the heat transfer tubes 112 of the second, fourth, and sixth intermediate tube banks 122, 126, 130 are arranged such that the heat transfer tubes 112 of the top tube bank 116, and the heat transfer tubes 112 of the second, fourth and sixth intermediate tube banks 122, 126, 130, are vertically aligned in columns. The heat transfer tubes 112 of the first, third, and fifth intermediate tube banks 120, 124, 128, and the bottom tube bank 118 are also arranged such that the heat transfer tubes 112 of the first, third, and fifth intermediate tube banks 120, 124, 128, and the heat transfer tubes 112 of the bottom tube bank 118 are vertically aligned in columns.

The first, third, and fifth intermediate tube banks 120, 124, 128, and the bottom tube bank 118 are vertically and horizontally offset from the top tube bank 116 and the second, fourth, and sixth intermediate tube banks 122, 126, 130 such that the heat transfer tubes 112 of the first, third, and fifth intermediate tube banks 120, 124, 128, and the bottom tube bank 118 are not vertically aligned and not horizontally aligned with the heat transfer tubes 112 of the top tube bank 116 and the second, fourth and sixth intermediate tube banks 122, 126, 130. Passageways 310 are provided between the heat transfer tubes 112 of the top tube bank 116, the heat transfer tubes of the first, second, third, fourth, fifth, and six intermediate tube banks 120, 122, 124, 126, 128, 130, and the heat transfer tubes 112 of the bottom tube bank 118 for bulk solids 110 to flow through.

The heat transfer tubes 112 of the first, third, and fifth intermediate tube banks 120, 124, 128 and the heat transfer tubes 112 of the bottom tube bank 118 may be horizontally and vertically offset from the heat transfer tubes 112 of the top tube bank 116 and the heat transfer tubes 112 of the second, fourth and sixth intermediate tube banks 122, 126, 130 such that the heat transfer tubes 112 of the first, third, and fifth intermediate tube banks 120, 124, 128 and the heat transfer tubes 112 of the bottom tube bank 118 are horizontally and vertically spaced by a suitable distance to facilitate the cooling zones between adjacent heat transfer tubes 112. For example, the heat transfer tubes 112 of the first, third, and fifth intermediate tube banks 120, 124, 128 and the heat transfer tubes 112 of the bottom tube bank 118 are horizontally spaced by a horizontal distance that is half of the distance between adjacent heat transfer tubes 112 of the top tube bank 116, and vertically spaced by a distance that is half of the distance from a heat transfer tube 112 in the top tube bank 116 to an adjacent heat transfer tube 112 in the second intermediate tube bank 120.

Alternatively, the heat transfer tubes 112 of the top tube bank 116, the first intermediate tube bank 120, the second intermediate tube bank 122, the third intermediate tube bank 124, the fourth intermediate tube bank 126, the fifth intermediate tube bank 128, the sixth intermediate tube bank 130, and the bottom tube bank 118 may be horizontally aligned in rows and vertically aligned in columns such that the passageways 310 extend through the entire tube stack 114.

The terms top, bottom, horizontal, and vertical are utilized herein to provide reference to the orientation of the heat exchanger 100 when assembled for use, as shown in FIG. 1. The term heat transfer tube is utilized herein to refer to a conduit through which fluid may flow. The heat transfer tube 112 is not limited to a cylindrical tube and may be any other suitable shape to facilitate fluid flow therethrough.

Referring again to FIG. 1 and FIG. 2, the heat exchanger 100 also includes a tube inlet manifold 154 for providing cooling fluid into each heat transfer tube 112 of the top tube bank 116, and into each heat transfer tube 112 of the first intermediate tube bank 120. The tube inlet manifold 154 is coupled to the housing 102 and is in fluid communication with each heat transfer tube 112 of the top tube bank 116 and each heat transfer tube 112 of the first intermediate tube bank 120. A respective fluid line 158 extends from the first end 306 of a respective heat transfer tube 112 of the top tube bank 116 to the tube inlet manifold 154. A respective fluid line 160 also extends from the first end 306 of a respective heat transfer tube 112 of the first intermediate tube bank 120 to the tube inlet manifold 154.

The heat exchanger 100 also includes a tube discharge manifold 156 for receiving cooling fluid discharged from each of heat transfer tube 112 of the sixth intermediate tube bank 130, and from each of heat transfer tube 112 of the bottom tube bank 118. The tube discharge manifold 156 is coupled to the housing 102 and is in fluid communication with each heat transfer tube 112 of the sixth intermediate tube bank 130, and each heat transfer tube 112 of the bottom tube bank 118. A respective fluid line 162 extends from the first end 306 of a respective heat transfer tube 112 of the sixth intermediate tube bank 130 to the tube discharge manifold 156. A respective fluid line 164 also extends from the first end 306 of a respective heat transfer tube 112 of the bottom tube bank 118 to the tube discharge manifold 156.

The cooling fluid may be any suitable fluid that transfers heat from bulk solids 110 that flow between adjacent heat transfer tubes 112, for example, water or thermal oil.

The heat transfer tubes 112 of the top tube bank 116, the second intermediate tube bank 122, the fourth intermediate tube bank 126, and the sixth intermediate tube bank 130 are arranged in columns and in fluid communication with each other in a serpentine manner. A respective fluid line 166 extends from the second end 308 of a respective heat transfer tube 112 of the top tube bank 116 to the second end 308 of a respective heat transfer tube 112 of the second intermediate tube bank 122. Similarly, a respective fluid line 168 extends from the first end 306 of a respective heat transfer tube 112 of the second intermediate tube bank 122 to the first end 306 of a respective heat transfer tube 112 of the fourth intermediate tube bank 126, and a respective fluid line 170 extends from the second end 308 of a respective heat transfer tube 112 of the fourth intermediate tube bank 126 to the second end 308 of a respective heat transfer tube 112 of the sixth intermediate tube bank 130.

The heat transfer tubes 112 of the first intermediate tube bank 120, the third intermediate tube bank 124, the fifth intermediate tube bank 128, and the bottom tube bank 118 are also arranged in columns and in fluid communication with each other in a serpentine manner. A respective fluid line 172 extends from the second end 308 of a respective heat transfer tube 112 of the first intermediate tube bank 120 to the second end 308 of a respective heat transfer tube 112 of the third intermediate tube bank 124. Similarly, a respective fluid line 174 extends from the first end 306 of a respective heat transfer tube 112 of the third intermediate tube bank 124 to the first end 306 of a respective heat transfer tube 112 of the fifth intermediate tube bank 128, and a respective fluid line 176 extends from the second end 308 of a respective heat transfer tube 112 of the fifth intermediate tube bank 128 to the second end 308 of a respective heat transfer tube 112 of the bottom tube bank 118.

Figure 5:
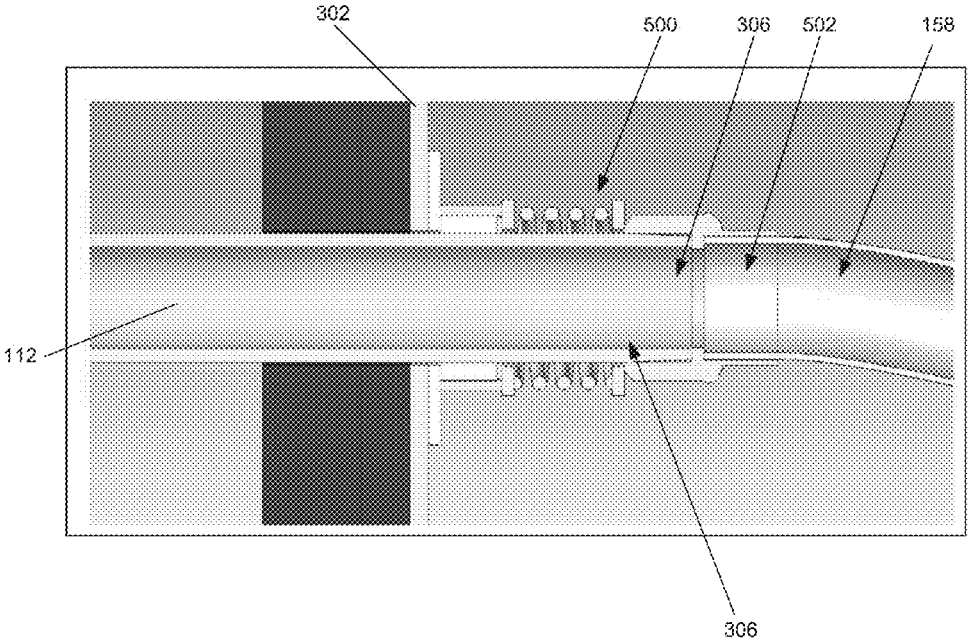
FIG. 5 is a side view of a portion a heat transfer tube of a top heat transfer tube bank of the heat exchanger of FIG. 1, that illustrates an example of a seal between an end of a heat transfer tube and an end of a fluid line.

Referring to FIG. 5, a side view of a portion of the heat exchanger 100 of FIG. 1 is shown, in which a first end 306 of a heat transfer tube 112 of the top tube bank 116 is coupled to an end 502 of a fluid line 158 by a seal 500. As shown in FIG. 5, the first end 306 of the heat transfer tube 112 passes through an opening in the first side wall 302 of the housing 102 and extends therethrough. The seal 500 facilitates movement of the heat transfer tube 112 within the housing 102 when cooling fluid flows from the respective fluid line 158 into the heat transfer tube 112 under high pressure.

Figure 6:
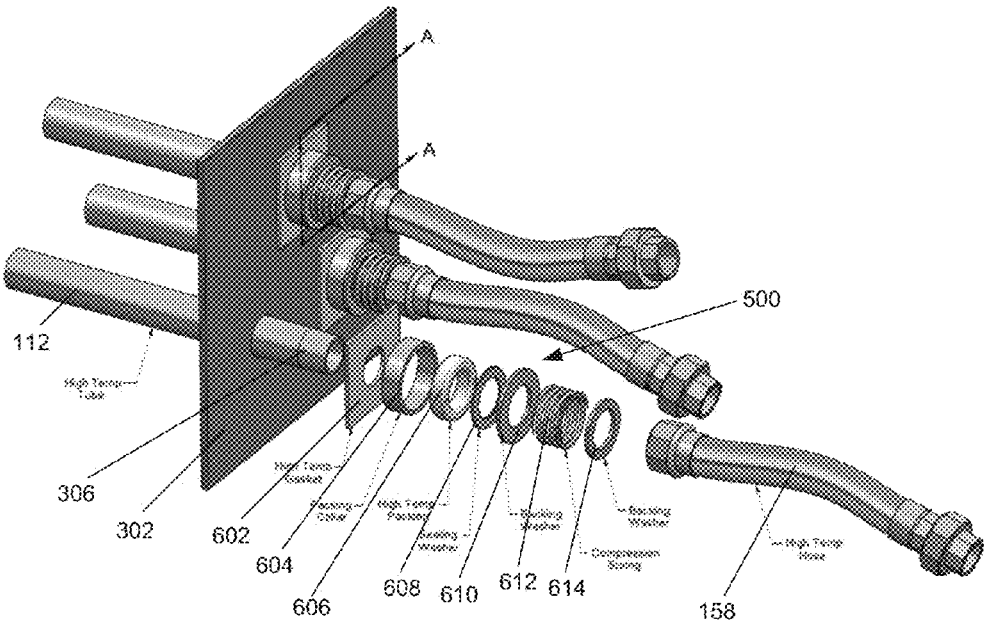
FIG. 6 is an exploded perspective view of an example embodiment of a seal of the heat exchanger of FIG. 1.

Referring to FIG. 6, an exploded perspective view of an example of the seal 500 is shown. The seal 500 includes a high temperature gasket 602, a packing collar 604, a high temperature packing 606, a sealing washer 608, a first backing washer 610, a compression spring 612, and a second backing washer 614. The high temperature gasket 602 forms a seal against the first sidewall 302 of the housing 102 of the heat exchanger 100 to inhibit any bulk solids 110 from being discharged from the housing 102 through a gap (not shown) between the heat transfer tube 112 and the opening in the first sidewall 302 through which the end 306 of the heat transfer tubes 112 passes through. The high temperature packing 606 seals against an outer surface of the heat transfer tube 112 to also inhibit any bulk solids 110 from discharging from the housing 102 through the gap between the heat transfer tube 112 and the opening in the first sidewall 302 of the housing 102. The sealing washer 608 holds the high temperature packing 606 in place and ensures that the heat transfer tube 112 is centered in the packing collar 604. The first backing washer 610 transfers pressure from the compression spring 612 to the packing collar 604, and in turn to the high temperature gasket 602 and the first sidewall 302, as cooling fluid flows through the heat transfer tube 112. The second backing washer 614 acts as a backing for the compression spring 612 against the respective fluid line 158.

The seal 500 is a leak resistant seal between the first end 306 of a heat transfer tube 112 and a respective fluid line 158 to inhibit leakage when a cooling fluid flows either into or from a first end 306 of the heat transfer tube 112.

In the example shown in FIG. 1 and FIG. 2, the first end 306 of each heat transfer tube 112 of the top tube bank 116 is coupled to an end 502 of a respective fluid line 158 by a seal 500. The second end 308 of each heat transfer tube 112 of the top tube bank 116 is also coupled to a second end of a respective fluid line 158 by a seal 500. Similarly, the first end 306 of each heat transfer tube 112 of the tube banks 118, 120, 122, 124, 126, 128, and 130 are coupled to a first end 502 of the respective fluid lines 164, 160, 168, 174, 162 by a seal 500. Also, the second end 308 of each heat transfer tube 112 of the tube banks 118, 120, 122, 124, 126, 128, 130 are coupled to a second end of the respective fluid lines 176, 166, 172, and 170 by a seal 500.

The flow of cooling fluid through the tube stack 114 will now be described with reference to FIG. 1 and FIG. 2. In operation, cooling fluid flows from the tube inlet manifold 154 to the tube discharge manifold 156 in a serpentine manner such that the cooling fluid flows from the tube inlet manifold 154, into the respective fluid lines 158, 160, through the heat transfer tubes 112 of the top tube bank 116 and the first intermediate tube bank 120, into the respective fluid lines 166, 172, through the heat transfer tubes 112 of the second intermediate tube bank 122 and the third intermediate tube bank 124, and into the respective fluid lines 168, 174. The cooling fluid then flows through the heat transfer tubes 112 of the fourth intermediate tube bank 126 and the fifth intermediate tube bank 128, into the respective fluid lines 170, 176, through the heat transfer tubes 112 of the sixth intermediate tube bank 130 and the bottom tube bank 118, into the respective fluid lines 162, 164, and into the tube discharge manifold 156.

Although the flow of cooling fluid has been described herein as flowing in a downward direction through the tube stack 114, in an alternative embodiment, the tube inlet manifold 154 may be a tube discharge manifold, the tube discharge manifold 156 may be a tube inlet manifold, and the direction of flow of the cooling fluid through the tube stack 114 and the heat transfer tubes 112 may be in an opposite direction to that described such that the cooling fluid flows upwardly through the tube stack 114.

Figure 7:
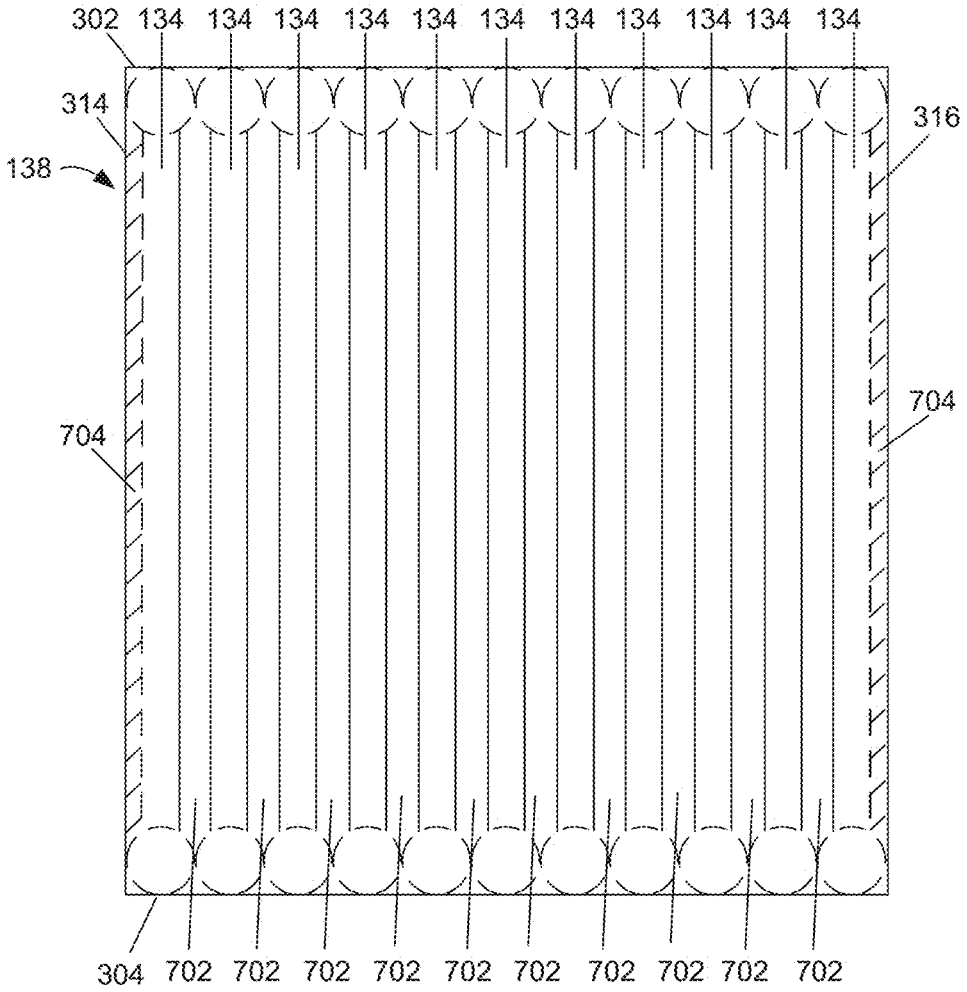
FIG. 7 is a top view of a top bank of heat transfer plate assemblies of the heat exchanger of FIG. 1.

Referring to FIG. 7, a top view of the top assembly bank 138 of the heat exchanger 100 of FIG. 1 is shown. Each high temperature heat transfer plate assembly 134 of the top assembly bank 138 extends the width of the housing 102 between the first side wall 302 of the housing 102 and the opposing second side wall 304 of housing 102. The high temperature heat transfer plate assemblies 134 are arranged generally parallel to each other with spaces between adjacent high temperature heat transfer plate assemblies 134. Each space between adjacent high temperature heat transfer plate assemblies 134 defines a passageway 702 for bulk solids 110 to flow through. Optionally, insulation 704 may be disposed between a third side wall 314 of the housing 102 and the high temperature heat transfer plate assembly 134 located adjacent to the third side wall 314. Insulation 704 may also be disposed between the fourth side wall 316, and the high temperature heat transfer plate assembly 134 located adjacent to or near the fourth sidewall 316. The insulation 704 may be a ceramic fiber sheet of suitable thickness that inhibits the flow of bulk solids 110 in the space between the third side wall 314 and the adjacent high temperature heat transfer plate assembly 134, and the space between the fourth side wall 316 and the adjacent high temperature heat transfer plate assembly 134, respectively.

Alternatively, a high temperature heat resistant lining 312 as shown in FIG. 3 and described above may be disposed between the third side wall 314 of the housing 102 and the high temperature heat transfer plate assembly 134 located adjacent to or near the third side wall 314, and the water-skin jacket 318 may be disposed on the outer surface of the third side wall 314. The high temperature heat resistant lining 312 may also be disposed between the fourth side wall 316 and the high temperature heat transfer plate assembly 134 located adjacent to or near the fourth sidewall 316 and the water-skin jacket 318 may also be disposed on the outer surface of the fourth side wall 316.

The bottom assembly bank 140 and the first and second intermediate assembly banks 142, 144 have a similar configuration as the top assembly bank 138.

The four assembly banks 138, 140, 142, and 144 of high temperature heat transfer plate assemblies 134 may be vertically aligned in columns in the housing 102 such that the passageways 702 extend through the entire assembly stack 136. Alternatively, the high temperature heat transfer plate assemblies 134 in the four assembly banks 138, 140, 142, and 144 may be arranged such that the high temperature heat transfer plate assemblies 134 are horizontally offset from one another.

Figure 8:
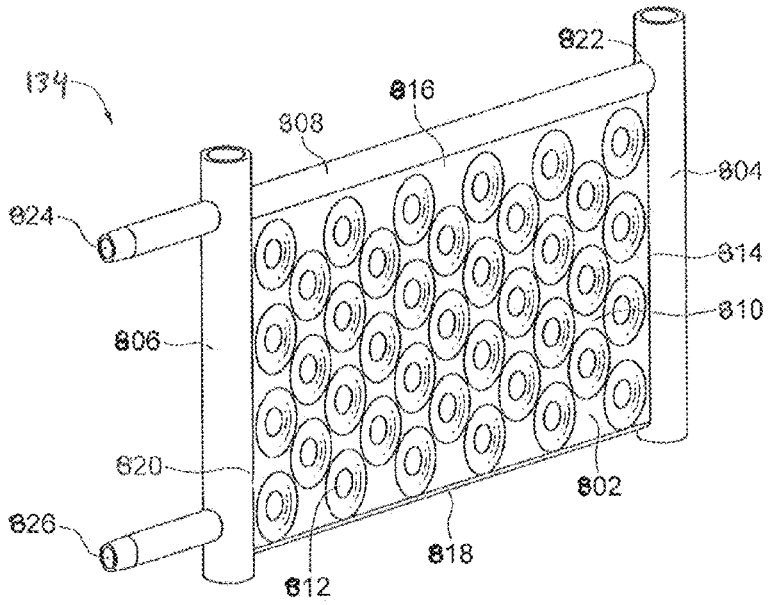
FIG. 8 is a perspective view of an example of a heat transfer plate assembly of the heat exchanger of FIG. 1.

A perspective view of an example of a high temperature heat transfer plate assembly 134 is shown in FIG. 8. The high temperature heat transfer plate assembly 134 includes a heat transfer plate 802, a first fluid conduit 804, and a second fluid conduit 806, and a pipe 808. The term pipe is utilized herein to refer to a conduit through which fluid may flow. The pipe 808 is not limited to a cylindrical pipe and may be any other suitable shape to facilitate fluid flow therethrough.

The heat transfer plate 802 includes a pair of metal sheets 810. The sheets 810 may be made from stainless steel, such as 316L stainless steel. The two sheets of the pair of sheets 810 are arranged generally parallel to each other. The two sheets are welded together at locations on each sheet and also seam welded along the bottom edges of the two sheets. After the two sheets 810 are welded together, the sheets are inflated such that generally circular depressions 812 are formed on each sheet. The generally circular depressions 812 are distributed throughout each sheet and are located at complementary locations on each sheet such that the generally circular depressions 812 on one of the sheets are generally aligned with the depressions 812 on the other of the sheets. When the sheets 810 are inflated, spaces are provided between the sheets 810 in areas where the sheets 810 are not welded together.

The first fluid conduit 804 extends along a first side edge 814 of the heat transfer plate 802, at least between a top end 816 and a bottom end 818 of the heat transfer plate 802. The first fluid conduit 804 is welded to the first side edge 814 of each of the sheets 810. The second fluid conduit 806 extends along an opposing second side edge 820 of the heat transfer plate 802, at least between the top end 816 and the bottom end 818 of the heat transfer plate 802. The second fluid conduit 806 is welded to the second side edge 820 of each of the sheets 810.

The pipe 808 extends along the top end 816 of the heat transfer plate 802. A first end 822 of the pipe 808 is in fluid communication with the first fluid conduit 804. The pipe 808 passes through the second fluid conduit 806. The pipe 808 may be in fluid communication with a top portion 910 (shown in FIG. 9) of the second fluid conduit 806. A second end 824 of the pipe 808 extends from the second fluid conduit 806 to provide a cooling fluid inlet. The pipe 808 is welded to the top edge of each of the sheets 810. The pipe 808 may have a diameter that is greater than or equal to the thickness of the heat transfer plate 802.

The high temperature heat transfer plate assembly 134 also includes a cooling fluid outlet 826. The cooling fluid outlet 826 extends substantially perpendicular to and away from the second fluid conduit 806. The cooling fluid outlet 826 is in fluid communication with the second fluid conduit 806.

In the example embodiment shown in FIG. 8, the cooling fluid outlet 826 is located near the bottom end 818 of the heat transfer plate 802. Alternatively, the cooling fluid outlet 826 may be located any suitable distance from the bottom end 818 of the heat transfer plate 802. For example, the cooling fluid outlet 826 may be located near the middle of the second fluid conduit 806.

The first fluid conduit 804 and the second fluid conduit 806 have diameters that are larger than the diameter of the pipe 808. When the high temperature heat transfer plate assemblies 134 are arranged in an assembly bank, the first fluid conduits 804 of adjacent high temperature heat transfer plate assemblies 134 abut each other and the second fluid conduits 806 of adjacent high temperature plate assemblies 134 abut each other, as shown in FIG. 7. The diameters of the first and second fluid conduits 804, 806 may be larger than the diameter of the pipe 808 to space apart the high temperature heat transfer plates 802 of adjacent high temperature heat transfer plate assemblies 134 when the high temperature heat transfer plate assemblies 134 are arranged in a bank. Alternatively, the high temperature heat transfer plate assemblies 134 may be arranged in an assembly bank such that the first fluid conduits 804 of adjacent heat transfer plate assemblies 134 are horizontally offset. For example, the first fluid conduits 804 of the first, third, fifth, seventh, ninth, and eleventh high temperature heat transfer plate assemblies 134 may be horizontally offset from the first fluid conduits 804 of the second, fourth, sixth, eighth, and tenth high temperature heat transfer plate assemblies 134 such that the first fluid conduits 804 of the first, third, fifth, seventh, ninth, and eleventh high temperature heat transfer plate assemblies 134 are not horizontally aligned with the first fluid conduits 804 of the second, fourth, sixth, eighth, and tenth high temperature heat transfer plate assemblies 134.

When the four assembly banks 138, 140, 142, and 144 are arranged in an assembly stack 136, the first fluid conduits 804 of one assembly bank may be aligned with the first fluid conduits 804 of the assembly bank that is directly below such that the first fluid conduits 804 of the lower assembly bank support the first fluid conduits 804 of the upper assembly bank. Similarly, the second fluid conduits 806 of the lower assembly bank support the second fluid conduits 806 of the upper assembly bank. Thus, a respective first fluid conduit 804 of a high temperature heat transfer plate assembly 134 of the top assembly bank 138 is disposed on a respective first fluid conduit 804 of a high temperature heat transfer plate assembly 134 of the first intermediate assembly bank 142, and a respective second fluid conduit 806 of a high temperature heat transfer plate assembly 134 of the top assembly bank 138 is disposed on a respective second fluid conduit 806 of a high temperature heat transfer plate assembly 134 of the first intermediate assembly bank 142. Similarly, a respective first fluid conduit 804 of a high temperature heat transfer plate assembly 134 of the first intermediate assembly bank 142 is disposed on a respective first fluid conduit 804 of a high temperature heat transfer plate assembly 134 of the second intermediate assembly bank 144, and a respective second fluid conduit 806 of a high temperature heat transfer plate assembly 134 of the first intermediate assembly bank 142 is disposed on a respective second fluid conduit 806 of a high temperature heat transfer plate assembly 134 of the second intermediate assembly bank 144.

Similarly, a respective first fluid conduit 804 of a high temperature heat transfer plate assembly 134 of the second intermediate assembly bank 144 is disposed on a respective first fluid conduit 804 of a high temperature heat transfer plate assembly 134 of the bottom assembly bank 140, and a respective second fluid conduit 806 of a high temperature heat transfer plate assembly 134 of the second intermediate assembly bank 144 is disposed on a respective second fluid conduit 806 of a high temperature heat transfer plate assembly 134 of the bottom assembly bank 140.

Figure 9:
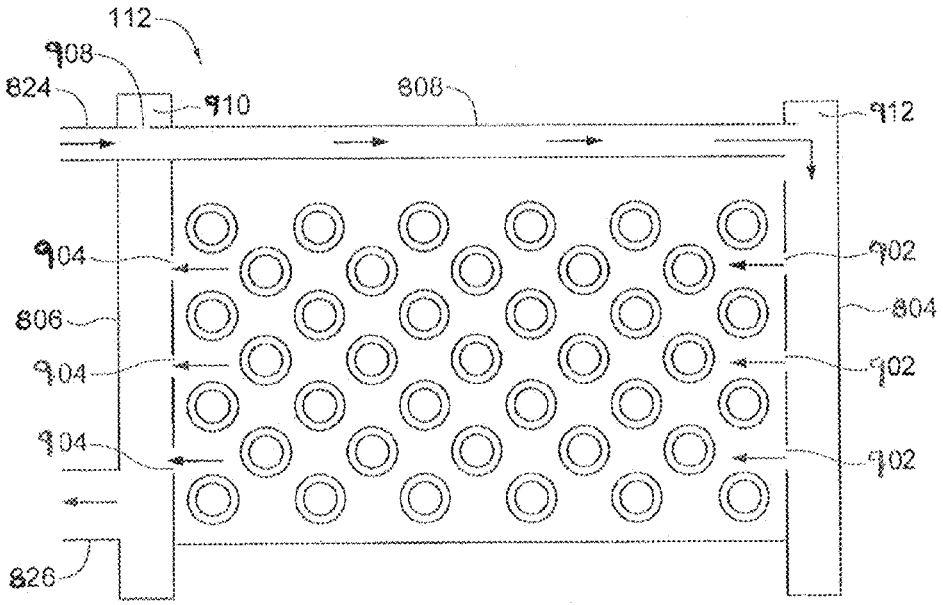
FIG. 9 is a sectional view of the high temperature heat transfer plate assembly of FIG. 8.

Referring to FIG. 9, a sectional view of the high temperature heat transfer plate assembly 134 of FIG. 8 is shown. The first fluid conduit 804 includes openings 902 into the heat transfer plate 802. The openings 902 are distributed along the first fluid conduit 804 at the first side 814 of the high temperature heat transfer plate 802. The openings 902 may be unevenly distributed such that the openings 902 are more closely spaced near the top of the first fluid conduit 804. Alternatively, the openings 902 may be larger near the top of the first fluid conduit 804. The second fluid conduit 806 includes openings 904 into the high temperature heat transfer plate 802. The openings 904 are distributed along the second fluid conduit 806 at the second side 820 of the heat transfer plate 802. The openings 904 may be unevenly distributed such that the openings 904 are more closely spaced near the top of the second fluid conduit 806. Alternatively, the openings 904 may be larger near the top of the second fluid conduit 806. The pipe 808 also includes an opening 908 to a top portion 910 of the second fluid conduit 806 to provide cooling fluid to the top portion 910 of the second fluid conduit 806.

The cooling fluid enters the top portion 910 of the second fluid conduit 806 through opening 908. The cooling fluid also enters the top portion 912 of the first fluid conduit 804. The top portion 910 of the second fluid conduit 806 and the top portion 912 of the first fluid conduit 804 may be sized to inhibit overheating of the top portions 910, 912. Thus, the top portions 910, 912 of the first and second fluid conduits 804, 806 are short enough to facilitate fluid flow and cooling of the top portions 910, 912. Additionally, fluid may flow through the top portions 910, 912 of the first and second fluid conduits 804, 806 to further cool the top portions 910, 912. To facilitate flow of cooling fluid, the outside diameter of the pipe 808 is sufficiently less than the inside diameter of the second fluid conduit 806 for fluid to flow from the top portion 910 into a lower portion of the second fluid conduit 806. With sufficient fluid flow, the top portions 910, 912 may be longer and spacing between the assembly banks 138, 140, 142, 144 that are arranged in the assembly stack 136 may be increased.

Referring again to FIG. 1 and FIG. 2, the heat exchanger 100 also includes a fluid inlet manifold 178 for providing cooling fluid into each high temperature heat transfer plate assembly 134 of the top assembly bank 138. The heat exchanger 100 also includes a fluid discharge manifold 180 for receiving cooling fluid discharged from each high temperature heat transfer plate assembly 134 of the bottom assembly bank 140. The fluid inlet manifold 178 is coupled to the housing 102 and is in fluid communication with each high temperature heat transfer plate assembly 134 of the top assembly bank 138. A respective fluid line 182 extends from each high temperature heat transfer plate assembly 134 of the top assembly bank 138 to the first fluid inlet manifold 178. The fluid discharge manifold 180 is coupled to the housing 102 and is in fluid communication with each high temperature heat transfer plate assembly 134 of the bottom assembly bank 140. A respective fluid line 184 extends from each high temperature heat transfer plate assembly 134 of the bottom assembly bank 140 to the first fluid discharge manifold 180. The cooling fluid may be any suitable fluid that transfers heat from bulk solids 110 that flow between adjacent high temperature heat transfer plate assemblies 134, for example water or thermal oil.

In the example of FIG. 1 and FIG. 2, the high temperature heat transfer plate assemblies 134 of the top assembly bank 138, the bottom assembly bank 140, and the two intermediate assembly banks 142, 144 are arranged in columns. The high temperature heat transfer plate assemblies 134 of each column are in fluid connection with each other. For example, a respective fluid line 186 extends from each high temperature heat transfer plate assembly 134 of the top assembly bank 138 to a respective heat transfer plate assembly 134 of the first intermediate assembly bank 142 of the same column. A respective fluid line 188 extends from each high temperature heat transfer plate assembly 134 of the first intermediate assembly bank 142 to a respective high temperature heat transfer plate assembly 134 of the second intermediate assembly bank 144 of the same column. A respective fluid line 190 extends from each high temperature heat transfer plate assembly 134 of the second intermediate assembly bank 144 to a respective high temperature heat transfer plate assembly 134 of the bottom assembly bank 140 of the same column.

The flow of cooling fluid through the assembly stack 136 will now be described with reference to FIG. 1, FIG. 8, and FIG. 9. The flow of the cooling fluid through a high temperature heat transfer plate assembly 134 is illustrated by the arrows in FIG. 9. In operation, cooling fluid flows from the fluid inlet manifold 178 through the respective fluid lines 182 into the respective pipes 808 of the high temperature heat transfer plate assemblies 134 of the top assembly bank 138. For the purposes of this example, the flow of cooling fluid through one of the high temperature heat transfer plate assemblies 134 will be described with reference to FIG. 9.

The cooling fluid flows through the pipe 808 of the high temperature heat transfer plate assembly 134 into the first fluid conduit 804. Cooling fluid also flows from the pipe 808, through the opening 908, and into the top portion 910 of the second fluid conduit 806. From the first fluid conduit 804, the cooling fluid flows into the heat transfer plate 802 through the openings 902. The cooling fluid flows through the heat transfer plate 802 into the second fluid conduit 806, through the openings 904 in the second fluid conduit 806. The generally circular depressions 812 distributed throughout the heat transfer plate 802 facilitate the flow of the cooling fluid throughout the heat transfer plate 802. The cooling fluid then flows from the second fluid conduit 806 into the cooling fluid outlet 826. The cooling fluid that flows through the assembly stack 136 may be the same cooling fluid that flows though tube stack 114. Alternatively, the cooling fluid that flows through the high temperature assembly stack 136 may be a different cooling fluid than the cooling fluid that flows through tube stack 114.

Referring again to FIG. 1, FIG. 8, and FIG. 9, the cooling fluid flows from the cooling fluid outlet 826 of each high temperature heat transfer plate assembly 134 of the top assembly bank 138, through the respective fluid lines 186, and into the respective pipes 808 of the heat transfer plate assemblies 134 of the first intermediate assembly bank 142. The cooling fluid flows through each high temperature heat transfer plate assembly 134 of the first intermediate assembly bank 142 in a similar manner as described above.

The cooling fluid then flows from the cooling fluid outlet 826 of the high temperature heat transfer plate assemblies 134 of the first intermediate high temperature heat transfer plate assembly bank 142, through the respective fluid lines 188, and into the respective pipes 808 of the high temperature heat transfer plate assemblies 134 of the second intermediate bank 144. The cooling fluid flows through each high temperature heat transfer plate assembly 134 of the second intermediate bank 144 in a similar manner as described above.

The cooling fluid then flows from the cooling fluid outlet 826 of the high temperature heat transfer plate assemblies 134 of the second intermediate assembly bank 144 through the respective fluid lines 190, and into the respective pipes 808 of the high temperature heat transfer plate assemblies 134 of the bottom assembly bank 140. The cooling fluid flows through each high temperature heat transfer plate assembly 134 of the bottom assembly bank 140 in a similar manner as described above.

The cooling fluid flows from the cooling fluid outlet 826 of each high temperature heat transfer plate assembly 134 of the bottom assembly bank 140 through the respective fluid lines 184, and into the fluid discharge manifold 180.

Although the flow of cooling fluid has been described herein as flowing in a downward direction through the assembly stack 136, in an alternative embodiment the fluid inlet manifold 178 may be a fluid discharge manifold, the fluid discharge manifold 180 may be a fluid inlet manifold, and the direction of flow of cooling fluid through the assembly stack 136 and the high temperature heat transfer plate assemblies 134 may be in an opposite direction to that described such that the cooling fluid flows upwardly through the assembly stack 136.

Figure 10:
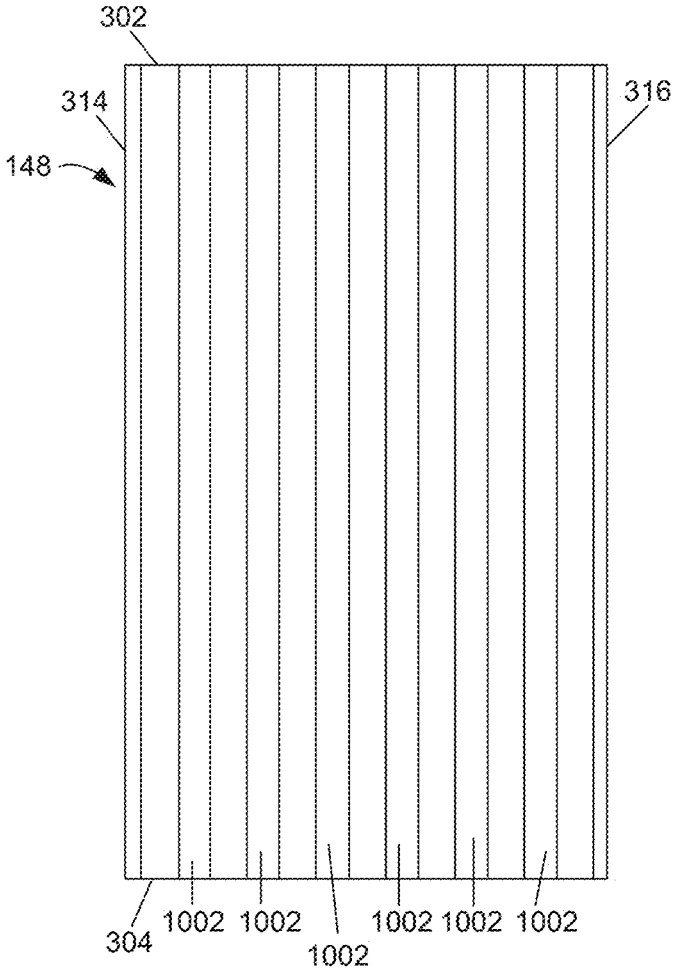
FIG. 10 is a top view of a bank of heat transfer plate assemblies of the heat exchanger of FIG. 1.

Referring to FIG. 10, a top view of the bank 148 of the heat exchanger 100 of FIG. 1 is shown. Each low temperature heat transfer plate assembly 146 of the bank 148 extends the width of the housing 102 between the first side wall 302 of the housing 102 and the opposing second side wall 304 of the housing 102. The low temperature heat transfer plate assemblies 146 are arranged generally parallel to each other with spaces between adjacent low temperature heat transfer plate assemblies 146. Each space between adjacent low temperature heat transfer plate assemblies 146 defines a passageway 1002 for bulk solids 110 to flow through.

Figure 11:
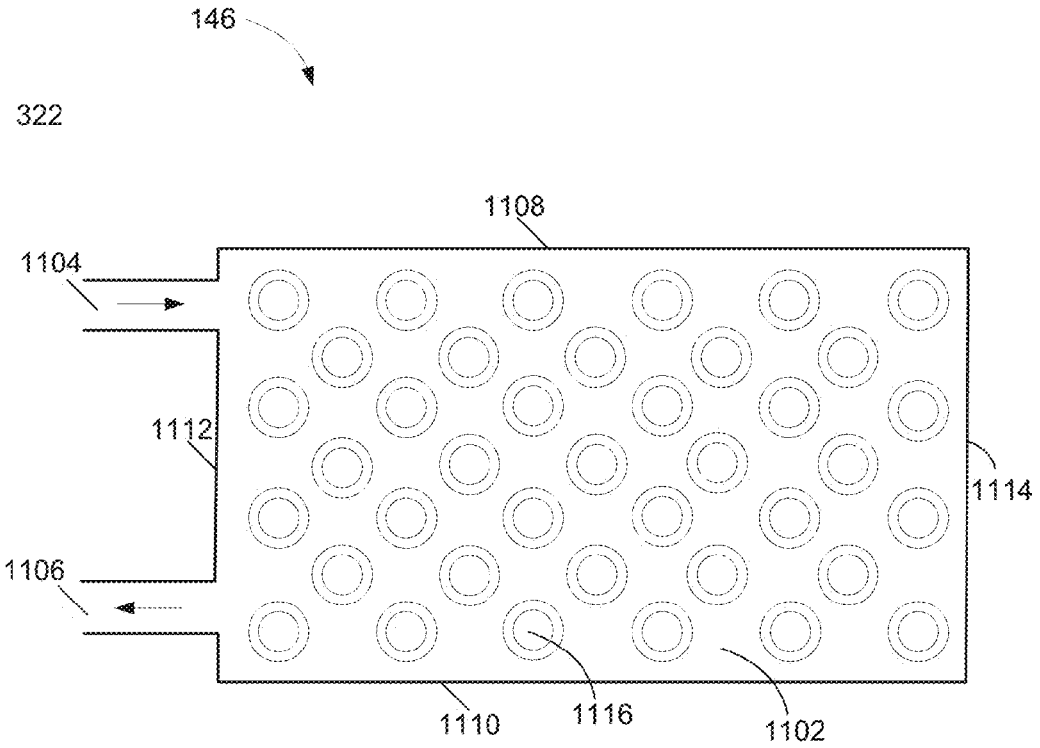
FIG. 11 is a sectional view of an example of a heat transfer plate assembly of the heat exchanger of FIG. 1.

A sectional view of an example of a low temperature heat transfer plate assembly 146 is shown in FIG. 11. The low temperature heat transfer plate assembly 146 includes a pair of metal sheets 1102, a fluid inlet 1104, and a fluid outlet 1106. The sheets 1102 may be made from stainless steel, such as 316L stainless steel. Each sheet 1102 includes a top edge 1108, a bottom edge 1110, a front side edge 1112, and an opposing rear side edge 1114.

The low temperature heat transfer plate assembly 146 may be assembled by, for example, arranging the pair of sheets 1102 generally parallel to each other. The sheets are welded together at locations distributed over the sheets and are seam welded along the top edges 1108, the opposing rear side edges 1114, and the bottom edges 1110 of the two sheets 1102. After the two sheets 1102 are welded together, slots are cut for insertion of nozzles that are welded to the sheets and are utilized as a fluid inlet 1104 and a fluid outlet 1106. The sheets 1102 are inflated utilizing the nozzles such that generally circular depressions 1116 are formed on each sheet. The generally circular depressions 1116 are distributed throughout each sheet and are located at complementary locations on each sheet such that the depressions 1116 on one of the sheets are generally aligned with the depressions 1116 on the other of the sheets. When the sheets 1102 are inflated, spaces are provided between the sheets 1102 in areas where the sheets 1102 are not welded together to facilitate fluid flow through the sheets 1102.

The fluid inlet 1104 extends from the front side edge 1112 of the sheets 1102 at a location near the top edge 1108 of the sheets 1102. The fluid outlet 1106 extends the front side edge 1112 of the sheets 1102 at a location near the bottom edge 1110 of the sheets 1102.

Referring again to FIG. 1 and FIG. 2, the heat exchanger 100 also includes an inlet manifold 192 for providing cooling fluid into each low temperature heat transfer plate assembly 146 of the bank 148 and a discharge manifold 194 for receiving cooling fluid discharged from each low temperature heat transfer plate assembly 146 of the bank 148. The inlet manifold 192 is coupled to the housing 102 and is in fluid communication with each low temperature heat transfer plate assembly 146 of the bank 148. A respective fluid line 196 extends from the inlet manifold 192 to a fluid inlet 1104 of each low temperature heat transfer plate assembly 146 of the bank 148. A respective fluid line 198 also extends from the discharge manifold 194 to a cooling fluid outlet 1106 of each heat transfer plate assembly 146 of the bank 148 as described in further detail below with reference to FIG. 11.

The flow of cooling fluid through the bank 148 will now be described with reference to FIG. 1, FIG. 2, and FIG. 11. The flow of the cooling fluid through a low temperature heat transfer plate assembly 146 is illustrated by the arrows in FIG. 11. In operation, cooling fluid flows from the inlet manifold 192 through the respective fluid lines 196, through the fluid inlet 1104 and into each low temperature heat transfer plate assemblies 146 of the bank 148. The cooling fluid then flows through each low temperature heat transfer plate assembly 146, through the fluid outlet 1106, through the respective fluid lines 198, and into the discharge manifold 194.

In an alternative embodiment, the direction of flow of cooling fluid through each low temperature heat transfer plate assembly 146 may be in an opposite direction to that described such that the cooling fluid flows from the discharge manifold 194, through the respective fluid lines 198, into the fluid outlets 1106, through each low temperature heat transfer plate assembly 146, into the fluid inlets 1104, through the respective fluid lines 196, and back into the inlet manifold 192.

In the example shown in FIG. 1 and FIG. 2, the eight tube banks 116, 118, 120, 122, 124, 126, 128, 130, the four assembly banks 138, 140, 142, 144, and the single bank 148 are arranged in the housing 102 such that the passageways 310, 702, 1002 are aligned and extend through the entire tube stack 114, the entire assembly stack 136, and the bank 148 to facilitate the flow of bulk solids 110 through the heat exchanger 100 from the inlet 108 to the outlet.

The operation of the heat exchanger 100 will now be described with reference to FIG. 1. When bulk solids 110 that have a starting temperature in the range of, for example, about 400° C. to about 2400° C. are fed into the housing 102, through the inlet 108, the bulk solids 110 flow downwardly as a result of the force of gravity from the inlet 108 into the hopper 132. The hopper 132 facilitates distribution of the bulk solids 110 into the top tube bank 118 as described above. The bulk solids 110 flow through passageways 310, and bulk solids 110 that contact the heat transfer tubes 112 are deflected into the passageways 310.

As the bulk solids 110 flow through the passageways 310, the bulk solids 110 are cooled to a first intermediate temperature as the heat from the bulk solids 110 is transferred to the heat transfer tubes 112 and to the cooling fluid. The bulk solids may be cooled to a first intermediate temperature of, for example, about 750° C. The cooling fluid that flows through the heat transfer tubes 112 indirectly cools bulk solids 110 to the first intermediate temperature.

After initial cooling of the bulk solids 110 to the first intermediate temperature by the heat transfer tubes 112, the bulk solids 110 that flow through passageways 310 flow towards the passageways 702. Bulk solids 110 that contact the high temperature heat transfer plate assemblies 134 are deflected into the passageways 702.

As the bulk solids 110 that have the first intermediate temperature flow through passageways 702, the bulk solids 110 are further cooled to a second intermediate temperature of, for example, about 400° C. The cooling fluid that flows through the high temperature heat transfer plate assemblies 134 indirectly cools bulk solids 110 to the second intermediate temperature.

After cooling of the bulk solids 110 to the second intermediate temperature by the high temperature heat transfer plate assemblies 134, the bulk solids 110 that flow through passageways 702 flow towards the passageways 1002. Bulk solids 110 that contact the low temperature heat transfer plate assemblies 146 are deflected into the passageways 1002.

As the bulk solids 110 that have the second intermediate temperature flow through passageways 1002, the bulk solids 110 are further cooled to a cooled temperature of, for example 100° C. The cooling fluid that flows through the low temperature heat transfer plate assemblies 146 indirectly cools bulk solids 110 to the resulting temperature.

The bulk solids 110 then flow from the passageways 1002, through the outlet, and into the discharge hopper 112, where the cooled bulk solids 110 are discharged under a "choked" flow.

Although the heat exchanger 100 shown in FIGS. 1 and 2 includes a tube stack 114, an assembly stack 136, and a single bank 148, in an alternative embodiment the heat exchanger 100 may include a tube stack 114 and an assembly stack 136. In this embodiment, the passageways 310 and 702 are vertically aligned such that bulk solids 110 flow through the heat exchanger 100 from the inlet 108, through the passageways 310 and 702, to the outlet. When bulk solids 110 that have a starting temperature in the range of, for example, about 400° C. to about 2400° C. are fed into the housing 102, through the inlet 108, the bulk solids 110 flow through the passageways 310, and the bulk solids 110 are cooled to an intermediate temperature as the heat from the bulk solids 110 is transferred to the heat transfer tubes 112 and to the cooling fluid. After initial cooling of the bulk solids 110 to the intermediate temperature by the heat transfer tubes 112, the bulk solids 110 that flow through passageways 310 flow towards the passageways 702 and the bulk solids 110 that contact the high temperature heat transfer plate assemblies 134 are deflected into the passageways 702. As the bulk solids 110 that have the first intermediate temperature flow through passageways 702, the bulk solids 110 are further cooled to a resulting temperature of, for example, about 400° C. The cooling fluid that flows through the high temperature heat transfer plate assemblies 134 indirectly cools bulk solids 110 to the resulting temperature. The bulk solids 110 then flow from the passageways 702, through the outlet, and into the discharge hopper 112, where the cooled bulk solids 110 are discharged under a "choked" flow.

In other embodiments, the heat exchanger 100 may include a tube stack 114 and a single bank 148 or multiple banks of low temperature heat transfer plate assemblies 146. In these embodiments, the passageways 310 and 1002 are vertically aligned such that bulk solids 110 flow through the heat exchanger 100 from the inlet 108, through the passageways 310 and 1002, to the outlet. When bulk solids 110 that have a starting temperature in the range of, for example, about 400° C. to about 2400° C. are fed into the housing 102, through the inlet 108, the bulk solids 110 flow through the passageways 310, and the bulk solids 110 are cooled to an intermediate temperature as the heat from the bulk solids 110 is transferred to the heat transfer tubes 112 and to the cooling fluid. After initial cooling of the bulk solids 110 to the intermediate temperature by the heat transfer tubes 112, the bulk solids 110 that flow through passageways 310 flow towards the passageways 1002. Bulk solids 110 that contact the low temperature heat transfer plate assemblies 146 are deflected into the passageways 1002. As the bulk solids 110 that have the first intermediate temperature flow through passageways 1002, the bulk solids 110 are further cooled to a resulting temperature of, for example, about 400° C. The cooling fluid that flows through the low temperature heat transfer plate assemblies 146 indirectly cools bulk solids 110 to the resulting temperature. The bulk solids 110 then flow from the passageways 1002, through the outlet, and into the discharge hopper 112, where the cooled bulk solids 110 are discharged under a "choked" flow.

Advantageously, the heat transfer tubes of the heat exchanger cool bulk solids having a starting, high temperature to an intermediate temperature before the bulk solids are cooled by the heat transfer plates of the heat exchanger to a resulting, cooled temperature. The cooling of bulk solids to an intermediate temperature by heat transfer tubes described herein before cooling the bulk solids to a resulting, cooled temperature by the heat transfer plate assemblies described herein, increases the operational life of the heat transfer plates and the heat exchanger described herein.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

The invention claimed is:

1. A heat exchanger comprising:

a housing including an inlet for receiving bulk solids, and an outlet for discharging the bulk solids;

a plurality of spaced apart, substantially parallel heat transfer tubes disposed within the housing between the inlet and the outlet, for cooling the bulk solids that flow from the inlet, to spaces between heat transfer tubes;

a plurality of spaced apart, substantially parallel high temperature heat transfer plate assemblies disposed within the housing and interposed between the plurality of heat transfer tubes and the outlet for further cooling the bulk solids that flow from the spaces between heat transfer tubes, to spaces between the high temperature heat transfer plate assemblies and to the outlet, ones of the high temperature heat transfer plate assemblies including:

a heat transfer plate comprising a pair of metal sheets coupled together and including spaces between the metal sheets for the flow of cooling fluid between the metal sheets;

a pipe extending along a top of the heat transfer plate to protect the heat transfer plate, the pipe including a fluid inlet at one end thereof for receiving cooling fluid in the pipe;

wherein the high temperature heat transfer plate assemblies are configured to receive cooling fluid into the high temperature heat transfer plate assembly through the fluid inlet of the pipe and for the cooling fluid to flow through the heat transfer plate.

2. The heat exchanger according to claim 1, wherein first ones of the plurality of heat transfer tubes are arranged in a first row, and second ones of the plurality of heat transfer tubes are arranged in a second row, and wherein the heat transfer tubes of the second row are spaced from the heat transfer tubes of the first row.

3. The heat exchanger according to claim 2, wherein each heat transfer tube of the second row is disposed between adjacent heat transfer tubes of the first row.

4. The heat exchanger according to claim 2, wherein third ones of the plurality of heat transfer tubes are arranged in a third row, and wherein the heat transfer tubes of the third row are spaced and aligned with respective heat transfer tubes of the first row.

5. The heat exchanger according to claim 1, comprising a refractory lining disposed within the housing between a first sidewall of the housing and the heat transfer tubes adjacent the first sidewall of the housing for cooling the bulk solids that flow between the first sidewall of the housing and the first heat transfer tubes located adjacent the first sidewall of the housing.

6. The heat exchanger according to claim 5, wherein the refractory lining is disposed within the housing between an opposing second sidewall of the housing and the heat transfer tubes located adjacent the second sidewall of the housing for cooling the bulk solids that flow between the second sidewall of the housing and the first heat transfer tubes located adjacent the second sidewall of the housing.

7. The heat exchanger according to claim 2, wherein the heat transfer tubes extend between a first sidewall of the housing and an opposing second sidewall of the housing.

8. The heat exchanger according to claim 3, wherein first ends of the heat transfer tubes pass through the first sidewall of the housing and second ends of the heat transfer tubes pass through the second sidewall of the housing.

9. The heat exchanger according to claim 4, wherein the first ends of the heat transfer tubes of the first row are coupled to the first sidewall of the housing by respective first seals.

10. The heat exchanger according to claim 4, comprising a cooling fluid inlet manifold in fluid communication with each first seal for providing cooling fluid into each heat transfer tube of the first row.

11. The heat exchanger according to claim 5, wherein a second end of each heat transfer tube of the first row is in fluid communication with a second end of each heat transfer tube of the second row for providing cooling fluid into each heat transfer tube of the second row.

12. The heat exchanger according to claim 7, wherein the first end of each heat transfer tube of the second row is coupled to the first sidewall of the housing by a second seal.

13. The heat exchanger according to claim 8, comprising a cooling fluid discharge manifold in fluid communication with each second seal for receiving cooling fluid discharged from each heat transfer tube assembly of the second row.

14. The heat exchanger according to claim 1, comprising a plurality of spaced apart, substantially parallel low temperature heat transfer plate assemblies disposed within the housing and interposed between the plurality of heat transfer plate assemblies and the outlet for further cooling the bulk solids that flow from the spaces between the heat transfer plate assemblies, to spaces between the low temperature heat transfer plate assemblies and to the outlet, to a fourth temperature.

15. The exchanger according to claim 1, wherein the high temperature heat transfer plate assemblies comprise:

a first fluid conduit extending along a first side of the heat transfer plate, the first fluid conduit in fluid communication with the pipe, near a second end of the pipe, to receive the cooling fluid from the pipe, and the first fluid conduit including first openings therein to provide fluid communication between the first fluid conduit and the heat transfer plate for the flow of the cooling fluid into the heat transfer plate; and a second fluid conduit extending along a second side of the heat transfer plate, which second side is opposite the first side, the second fluid conduit including second openings therein to provide fluid communication between the heat transfer plate and the second fluid conduit for the flow of the cooling fluid into the second fluid conduit, and a fluid outlet for the flow of the cooling fluid out of the second fluid conduit.

16. A heat exchanger comprising:

a housing including an inlet for receiving bulk solids, and an outlet for discharging the bulk solids;

a plurality of spaced apart, substantially parallel heat transfer tubes disposed within the housing between the inlet and the outlet, for cooling the bulk solids that flow from the inlet, to spaces between heat transfer tubes, the heat transfer tubes arranged in rows of tubes;

a plurality of spaced apart, substantially parallel first heat transfer plate assemblies disposed within the housing and interposed between the plurality of heat transfer tubes and the outlet for further cooling the bulk solids that flow from the spaces between heat transfer tubes, to spaces between the first heat transfer plate assemblies and to the outlet, the first heat transfer plate assemblies each including a pipe extending along a top end of a respective heat transfer plate and configured for fluid flow therethrough to protect the heat transfer plate;

a plurality of spaced apart, substantially parallel second heat transfer plate assemblies disposed within the housing, interposed between the first plurality of spaced apart, substantially parallel heat transfer plate assemblies and the outlet for further cooling the bulk solids that flow from the spaces between the first heat transfer plate assemblies, through spaces between the second heat transfer plate assemblies, and to the outlet.

17. The heat exchanger according to claim 16, wherein the heat transfer tubes are arranged in a first row, a second row, and a third row and wherein heat transfer tubes of the third row are generally vertically aligned with heat transfer tubes of the first row.

18. The heat exchanger according to claim 17, wherein heat transfer tubes of the second row are generally vertically offset from the heat transfer tubes of the first row.

* * * * *